United States Patent [19]

Maccarone et al.

[11] Patent Number: 4,679,702

[45] Date of Patent: Jul. 14, 1987

[54] SANITARY DRINKING ACCESSORY FOR A METAL BEVERAGE CAN

[75] Inventors: Anthony J. Maccarone, Glendale, Ariz.; Stephen M. Orr, San Luis Obispo, Calif.

[73] Assignee: By Macaroni, Inc., Glendale, Ariz.

[21] Appl. No.: 915,426

[22] Filed: Oct. 6, 1986

[51] Int. Cl.[4] ..... A47G 19/22; B65D 25/48; B65D 39/00

[52] U.S. Cl. ..... 220/90.2; 220/307; 222/570

[58] Field of Search ..... 220/90.2, 90.4, 90.6, 220/307; 222/569, 570

[56] References Cited

U.S. PATENT DOCUMENTS

| | | | |
|---|---|---|---|
| 2,839,229 | 6/1958 | Scheswohl | 220/90.4 |
| 3,031,111 | 4/1962 | Stull | 220/375 |
| 3,197,089 | 7/1965 | Michael | 222/570 |
| 3,229,868 | 1/1966 | Bayne | 222/570 |
| 4,023,728 | 5/1977 | Gamberg | 222/570 |
| 4,098,439 | 7/1978 | Blow | 220/90.4 |
| 4,478,346 | 10/1984 | Spong | 220/90.2 |
| 4,579,257 | 4/1986 | Brandlein | 220/90.6 |

FOREIGN PATENT DOCUMENTS

| | | | |
|---|---|---|---|
| 112303 | 6/1984 | European Pat. Off. | 220/307 |
| 2641874 | 3/1978 | Fed. Rep. of Germany | 220/90.4 |

*Primary Examiner*—George E. Lowrance
*Attorney, Agent, or Firm*—James H. Phillips

[57] ABSTRACT

A sanitary drinking accessory is disclosed for use with a metal beverage can after it has been opened by actuating an integral "pop-top" feature. The drinking accessory has a unitary body fabricated from a resilient material which is not inherently potentially toxic when brought into contact with a human mouth. The peripheral shape of the drinking accessory includes a rear section and a front section which is shaped, in horizontal cross section, in the form of a circular section generally conforming to the curve of the circumference of the top of the beverage can. An aperture extends through the accessory and terminates, at its upper end, in an outwardly flared manner such that its upper section merges with the top surface. A drinking lip, defined by contiguous portions of the top surface and the top of the front section of the periphery, permits the beverage to be channeled through the aperture and across the accessory lip to the lips of the consumer, the beverage therefore not encountering the exterior of the can. A tab downwardly depending from the front section of the periphery facilitates removal of the accessory by manually pulling the tab outwardly away from the can body. An optional configuration is also disclosed which includes an integral stopper dimensioned and configured to detachably seal the aperture.

3 Claims, 5 Drawing Figures

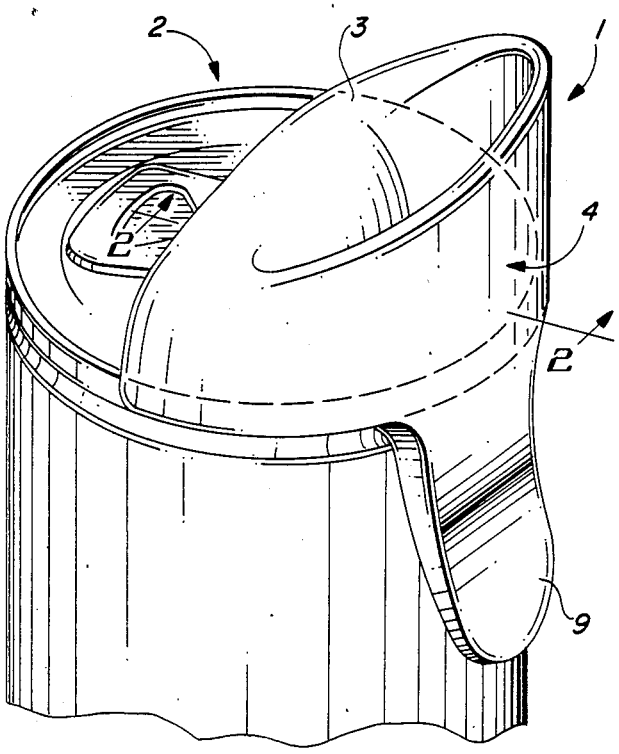
FIG. 1
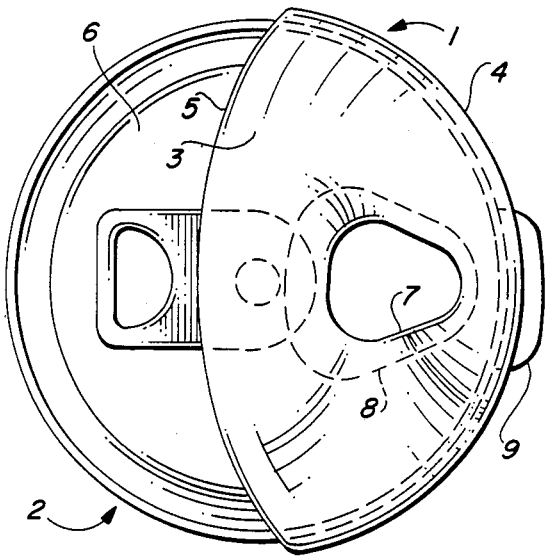
FIG. 3
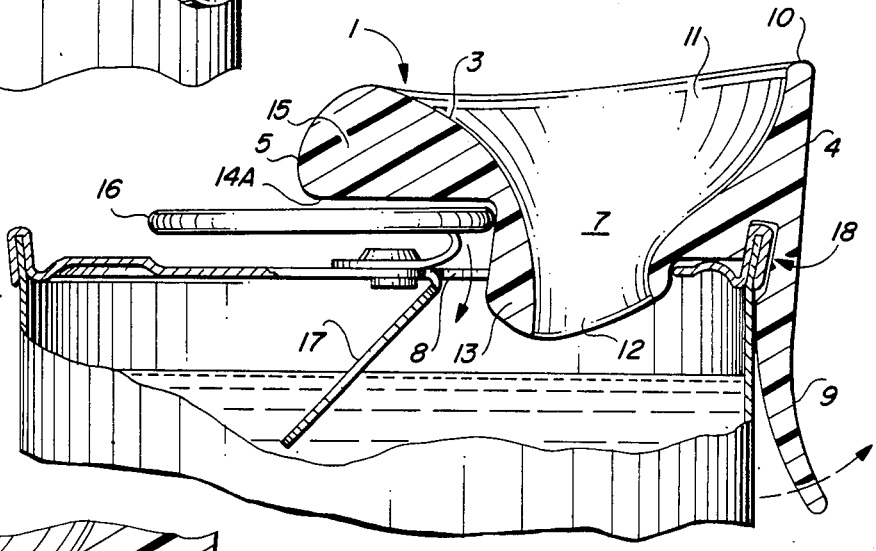
FIG. 2
FIG. 4
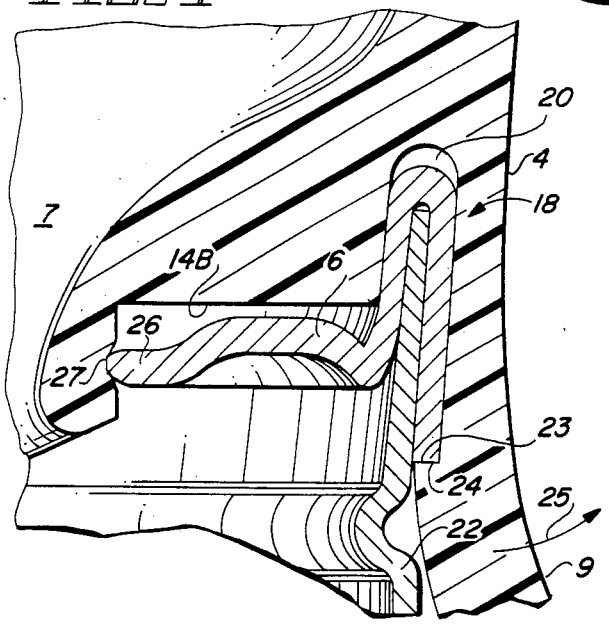
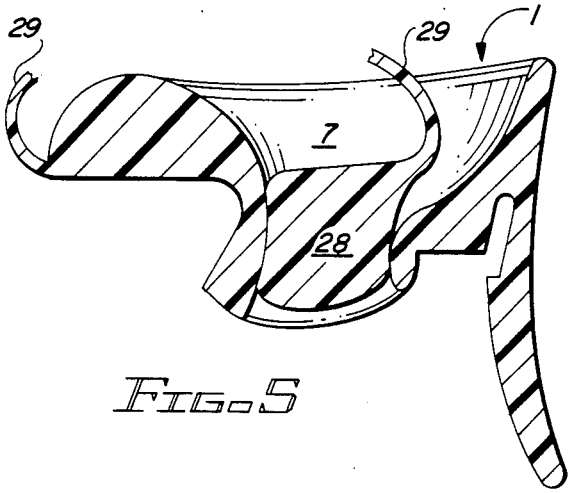
FIG. 5

SANITARY DRINKING ACCESSORY FOR A METAL BEVERAGE CAN

FIELD OF THE INVENTION

This invention relates to the canned beverage art and, more particularly, to a sanitary drinking accessory adapted to be detachably coupled to a metal beverage can of the type which is provided with an integral, manually operable, feature for effecting an opening in the can lid to permit consumption of the contents.

BACKGROUND OF THE INVENTION

A very large variety and enormous quantities of beverages are prepared and distributed, for end use by the consuming public, in metal (typically, aluminum) cans of the type (sometimes colloquially called "pop-top") which are provided with an integral manually-operable feature for effecting an opening in the can lid in order that the beverage may be consumed directly from the can or poured into another container. Merely by way of example, the beverages available in such metal cans include: beer, soft drinks, fruit and vegetable juices, milk, etc. Often, the consumer simply drinks the beverage directly from the can after it has been opened by actuating the opening mechanism in the can top. However, the lack of sanitation in drinking directly from the can is self evident and notoriously well known. More particularly, while the beverage itself and the interior of a typical beverage can (prior to opening) is almost uniformly sanitary, the outside of the can in the region of the opening where the lips must be placed to drink from the can are rarely sanitary and are often most unsanitary. Even if the exterior of the container had been reasonably clean upon leaving the assembly line in the factor in which it was filled and sealed, the subsequent handling chain through the several commercial and personal links present a virtual likelihood of serious contamination by bacteria, virus and other organisms and by other unsanitary contaminants such as dust, dirt and grease. Other drawbacks of drinking directly from a metal beverage can include the fact that the can edge is sometimes uncomfortable to the consumer's lips and, more particularly, sharp, and therefore potentially dangerous, edges are sometimes encountered.

These problems have been addressed in the prior art with both integral means included with a beverage can as provided to the consumer and accessory means for attachment to a can by the consumer. Thus, U.S. Pat. No. 4,561,557 to Park et al discloses a metal beverage container in which actuation of the opening tab automatically released an integral metal pouring spout. U.S. Pat. No. 4,407,425 to Combs discloses a closure lide for beverage containers which includes a folded resilient drinking spout that may be privoted upwardly and outwardly to permit accessing the beverage. U.S. Pat. No. 4,403,709 to Meins et al discloses an integral drinking and pouring aid for beverage cans in which the cover or lid surface is provided with a nipple-like mouth piece in the region of the can opening and which springs upwardly into an operative position upon opening the can. Similarly, U.S. Pat. No. 4,415,097, also to Meins, discloses a variation in which a drinking accessory fits over the entire upper surface of a can and is provided with a nipple-like mouthpiece in the vicinity of the can opening. The mouthpiece is flexible and can be collapsed in the vicinity of the outer surface of the cover. U.S. Pat. No. 3,372,832 to Yeater et al also discloses an accessory cover encompassing the entire lid of a beverage container and which further includes a closure cap and removable plug member to permit selective opening and sealing of the access port. These prior art approaches to the problem are certainly not without merit, but are complex to implement (particularly the integral means) and do not necessarily, positively perform the positive sanitation function sought.

Therefore, it will be appreciated that it would be highly desirable to provide means by which the significant advantages of manually openable metal beverage cans can be enjoyed, including drinking directly from the can once it has been opened, without the attendant drawbacks of exposing the lips and the system of the consumer to, at best, unsanitary conditions and, at worst, a potentially dangerous contamination. It is to these ends that our invention is directed.

OBJECTS OF THE INVENTION

It is therefore a broad object of our invention to provide an improved drinking accessory for use with a manually openable beverage can.

It is another object of our invention to provide such a drinking accessory which may be detachable coupled to the top of a metal beverage can in order that a consumer may drink from the can without the consumer's lips touching it.

In another aspect, it is an object of our invention to provide such a drinking accessory which channels the beverage flow from the normal can opening to the mouth of the consumer without the beverage touching the can exterior.

It is yet another object of our invention to provide such a drinking accessory which is fabricated in a unitary body from a resilient material which is not inherently potentially toxic and which presents no sharp edges when brought into contact with a human mouth.

In yet another aspect, it is an object of our invention to provide such a drinking accessory which is inexpensive to manufacture and which therefore may be used in either throwaway or reusable modes.

SUMMARY OF THE INVENTION

Briefly, these and other objects of our invention are achieved with a sanitary drinking accessory which may be readily detachably coupled to the top of a metal beverage can after it has been opened by actuating an integral "pop-top" feature. The drinking accessory has a unitary body fabricated from a resilient material, such as any of a number of common plastics, which is not inherently potentially toxic when brought into contact with a human mouth. The unitary body is provided with a top surface, a bottom surface and an intermediate zone between the top and bottom surfaces. The peripheral shape of the drinking accessory includes a rear section and a front section which has a top and a bottom and is shaped, in horizontal cross section, in the form of a circular section generally conforming to the curve of the circumference of the top of the beverage can with which the accessory is to be used. An aperture extends completely through the intermediate zone and terminates, at its upper end, in an outwardly flared manner such that its upper section merges with the top surface. A drinking lip, defined by contiguous portions of the top surface and the top of the front section of the periphery, permits the beverage to be channeled through the aperture (whose lower portion extends into the can opening) and across the accessory lip to the lips of the consumer, the beverage therefore not encountering the exterior of the can. A preferred means for detachably affixing the accessory to the can includes the provision of a recess disposed between the accessory bottom surface and the front section of the periphery, the recess being dimensioned and configured to snugly receive the can raised edge. A tab downwardly depending from the front section of the periphery facilitates removal of the accessory by manually pulling the tab outwardly away from the can body. When the accessory is operably fixed to the can, an upwardly facing shoulder in the recess engages a correspondingly downwardly facing shoulder of the can top. In an optional configuration, an integral stopper, dimensioned and configured to detachably seal the aperture, may be provided.

DESCRIPTION OF THE DRAWING

The subject matter of the invention is particularly pointed out and distinctly claimed in the concluding portion of the specification. The invention, however, both as to organization and method of operation, may best be understood by reference to the following description taken in conjunction with the subjoined claims and the accompanying drawing of which:

FIG. 1 is a partially cutaway pictoral view illustrating the drinking accessory according to the present invention operably affixed to the top of an exemplary beverage can;

FIG. 2 is a cross sectional view taken along the lines 2—2 of FIG. 1 illustrating the internal structure of the drinking accessory and particularly showing its cooperative relationship, when operably in place, with various components of the exemplary metal beverage can;

FIG. 3 is a top view of the subject drinking accessory illustrated affixed to an exemplary metal beverage can and particularly showing the degree to which it encompasses the periphery of the can top and partially covers the same;

FIG. 4 is a detailed cross sectional view taken in the region at which a recess feature of the drinking accessory is locked to the raised edge of the top of a beverage can; and FIG. 5 is a partially broken away cross sectional view of a variant configuration for the subject drinking accessory which includes an optional stopper.

DETAILED DESCRIPTION OF THE INVENTION

Refering now to FIG. 1, the drinking accessory 1 is illustrated in a typical position affixed to the top of a metal beverage can 2 which is of the well known general type provided with an integral, manually-operable feature for effecting an opening in the can lid to provide access to the beverage contained in the can. Cans of the general type contemplated include those fitted with completely detachable tabs and tabs which, when manipulated by the user, effect the opening, but remain fixed to the can. Merely for purposes of illustration, the exemplary beverage can 2 is of the latter type.

Referring to both FIGS. 1 and 3, it will be observed that the drinking accessory 1 has a top surface 3, a periphery including a front section 4 (nearest the consumer when in use) and a rear section 5 which terminates away from the user and intermediate the diameter of the top 6 of the beverage can 2. Thus, as best shown in FIG. 3, the drinking accessory 1 covers only a portion (preferably somewhat more than half) of the can top 6.

The drinking accessory 1 further includes an aperture 7 which is, when the accessory 1 is operably positioned on the can 2, in alignment with the opening 8 which has been previously obtained by actuating the manually operable can opening means. The aperture 7, at its smallest throat dimensions, is smaller than the can opening 8 for reasons which will become more apparent as the description of the drinking accessory proceeds. A tab 9, whose function will also be discussed more completely below, depends downwardly from a position central to the bottom of the front section 4 of the accessory periphery.

Attention is now directed to FIG. 2 which is a cross sectional view revealing the operative integration of the drinking accessory 1 with the can 2. This view also clearly illustrates that the aperture 7 flares outwardly at its upper section such that its side walls merge with and comprise at least a portion of the top surface 3 of the accessory 1. In addition, it may be noted that the upper section of the aperture 7 and the top of the front section 4 of the drinking accessory periphery merge to form a drinking lip 10. The lower section 12 of the aperture 7 extends through a downward extension 13 of the body of the drinking accessory 1 such that the lower terminus of the aperture 7 is actually within the interior of the beverage can 2.

The bottom surface **14*a* 14*b*, together with the top surface 3, defines an intermediate zone 15 which determines the thickness of the unitary drinking accessory 1 at the various positions. Bottom surface region 14*a* extends just over external pull tab 16 as it has been laid back after the can has been opened by the manipulation of the pull tab 16 to force the inside tab 17 into the can interior to effect the can opening 8. Those skilled in the are will understand that most of the can opening 8 is pre-corrugated to yield a reproducible shear fracture line. Along this portion of the can opening, a reliable fluid seal must be provided. It will be observed that a region of the can opening 8 between the downward extension 13 of the drinking accessory 1 and the upper pivot point of the inside tab 17 remains open to admit air as the beverage is consumed to thereby facilitate its free flow through the aperture 7. This area of the can opening is typically non-corrugated and tears open in a more or less uncontrolled manner during the opening process. The resultant somewhat jagged edge of the can opening 8 in this region does not contact, and therefore does not damage, the drinking accessory 1**.

As previously mentioned, means are provided to securely, but removably affix the drinking accessory 1 to the can 2. This is achieved be the integral attachment means 18 which is best understood by reference to FIG. 4. Thus, as shown in FIG. 4, the integral attachment means 18 includes a recess 20 between the bottom surface **14*b* (which is lower than the bottom surface 14*a* on the opposite side of the drinking accessory 1) and the front section 4 of the drinking accessory periphery. The recess 20 is dimensioned and configured to snugly receive the can raised edge 21 situated at the junction between the can lid 6 and the can body 22. It will be particularly observed in FIG. 4 that a downwardly facing circumferential shoulder 23, inherent in the typical construction of metal beverage cans, is closely engaged by a corresponding upwardly facing shoulder 24 situated in the region of the accessory 1 at which the tab 9 depends from the front section 4 of the accessory periphery. It will be apparent from a study of FIGS. 2 and 4 that the shoulders 23, 24 will snap into engagement as the resilient drinking accessory 1 is pushed into its operative position and that, when the tab 9 is pulled in the direction of the arrow 25 (FIG. 4**), release of the drinking accessory from the beverage can is facilitated.

While it is necessary that air be permitted to enter the interior of the beverage can 2 during the drinking process, it is essential that this air enter through the region between the downward extension 13 of the drinking accessory 1 and the upper end of the pivoted inner tab 17 through the can opening 8 and not closer to the forward section 4 of the accessory periphery. The reason for this requirement is to simply prevent "dribbling" of the consumed beverage down the region beneath the consumer's mouth which could cause soiling of clothes, the surrounding floor, etc, as well as cause discomfort to the consumer. Such dribbling is prevented by the seal achieved by cooperation between the inside edge 26 of the can opening 8 and a vertically oriented shoulder 27 of the accessory 1, which vertical shoulder resliently and sealingly engages the inside edge as best shown in FIG. 4. Thus, when the beverage can 2 is tilted toward the consumer in the natural drinking motion, no liquid is allowed to flow except as intended through the aperture 7 which is in alignment with the can opening 8. As previously mentioned, the make-up air passes through the opening toward the center of the can between the drinking accessory 1 and the beverage can 2.

FIG. 5 shows a variant embodiment of the drinking accessory 1 which further includes an integral stopper 28 wlhich is dimensioned and configured to detachably seal the aperture 7 as may be desirable when a drink is only partially consumed. Preferably, the stopper 28 is directly attached to the drinking accessory 1 by an integral cord-like retainer 29 which is shown broken away in FIG. 5.

The subject drinking accessory 1 is preferably molded in one piece from a material which is not toxic to the consumer and which is sufficiently resilient to admit of the attachment and detachment processes as well as insuring the seal between the inside edge 26 of the can opening 8 and the vertically oriented shoulder 27 and presenting a comfortable "feel" to the consumer. Numerous well known synthetic plastics meet these criteria, and the selection of the material of fabrication is therefore more thoroughly governed by economic considerations at the time of fabrication.

Thus, while the principles of the invention have now been made clear in an illustrative embodiment, there will be immediately obvious to those skilled in the art many modifications of structure, arrangements, proportions, the elements, materials, and components, used in the practice of the invention which are particularly adapted for specific environments and operating requirements without departing from those principles.

We claim:

1. A sanitary drinking accessory adapted to be detachably coupled to the top of a metal beverage can of the type which is provided with an integral manually-operable feature for effecting an opening in the can lid in order that the beverage may be consumed directly from the can, the can being further characterized by a can lid which has been fixed to the can body in such a manner that the junction between the can lid and the can body includes a circumferential raised edge and terminates in a circumferential, downwardly facing shoulder extending about the can body proximate its top edge, said drinking accessory comprising:

(A) a unitary body fabricated from a resilient plastic material which is not inherently potentially toxic when brought into contact with a human mouth; and (B) said unitary body having:
1. a top surface;
2. a bottom surface;
3. an intermediate zone between said top surface and said bottom surface and defining the thickness of said unitary body at each position across said top surface and said bottom surface;
4. a periphery, said periphery including:
   a. a rear section, and
   b. a front section, said front section having:
      i. a top;
      ii. a bottom; and
      iii. a shape, in horizontal cross section, in the form of a circular section generally conforming to the curve of the circumference of the top of the beverage can with which said drinking accessory is to be used;
5. an aperture extending completely through said intermediate zone, said aperture having an upper section and a lower section:
   a. said aperture flaring outwardly at its upper section such that its side walls merge with and comrise at least a portion of said top surface;
6. a drinking lip defined by contiguous portions of said top surface and said top of said front section of said periphery,
7. integral attachment means for detachably fixing said unitary body to a beverage can, of which the manually-operable feature has been actuated to obtain an opening in the can lid, such that:
   a. said front section of said periphery encompasses at least a portion of the circumference of the can top
   b. said rear section of said periphery extends beyond the opening in the can lid; and
   c. said lower section of said aperture is aligned with the opening in the can lid; and
8. said integral attachment means further comprising:
   1. a recess disposed between said bottom surface and said front section of said periphery, said recess being dimensioned and configured to snugly receive the can raised edge when said drinking accessory has been operably affixed to a can; and
   2. a tab depending downwardly from said front section of said periphery;

whereby, when said drinking accessory has been attached to the beverage can, a consumer may drink the can contents from said drinking lip without touching the can directly with his mouth and removal of said drinking accessory from the can may be facilitated by manually pulling the tab outwardly away from the can body to thereby increase the clearance between said recess and the can raised edge such that said drinking accessory may be peeled away from the can.

2. The drinking accessory of claim 1 in which said recess includes an upwardly facing shoulder adapted to engaged the downwardly facing circumferential shoulder of the can when the drinking accessory is operably fixed to the can and which is further adapted to at least partially disengage the downardly facing shoulder when said tab is pulled outwardly away from the can body.

3. The drinking accessory of claim 1 which further includes an integral stopper dimensioned and configured to detachable seal said aperture.

* * * * *